US005415404A

United States Patent [19]

Joshi et al.

[11] Patent Number: 5,415,404

[45] Date of Patent: May 16, 1995

[54] MULTI-PAY VIDEO POKER MACHINE

[75] Inventors: Shridhar P. Joshi, Chicago; John P. Nicastro, Sr., Lemont, both of Ill.

[73] Assignee: WMS Gaming, Inc., Chicago, Ill.

[21] Appl. No.: 154,981

[22] Filed: Nov. 19, 1993

[51] Int. Cl.[6] ..... A63F 3/00

[52] U.S. Cl. ..... 273/138 A; 273/85 CP; 273/292; 273/274; 364/412

[58] Field of Search ..... 273/292, 85 CP, 274, 273/138 A; 364/412

[56] References Cited

U.S. PATENT DOCUMENTS

| | | | |
|---|---|---|---|
| 4,743,022 | 5/1988 | Wood | 273/85 CP |
| 5,022,653 | 6/1991 | Suttle et al. | 273/85 CP |
| 5,042,818 | 8/1991 | Weingardt | 273/292 |
| 5,167,413 | 12/1992 | Fulton | 273/85 CP |
| 5,249,800 | 10/1993 | Hilgendorf et al. | 273/138 A |
| 5,294,128 | 3/1994 | Marquez | 273/292 |
| 5,299,120 | 5/1994 | Schultz | 2 B/85 CP |
| 5,322,295 | 6/1994 | Cabot et al. | 273/292 |
| 5,332,219 | 7/1994 | Marnell, II et al. | 273/138 A |

*Primary Examiner*—Vincent Millin
*Assistant Examiner*—Kerry Owens
*Attorney, Agent, or Firm*—Rockey, Rifkin and Ryther

[57] ABSTRACT

A multi-pay video poker machine includes a microprocessor based video display system. The program permits higher payoffs when compared to conventional video poker games. In accordance with the present invention, it is recognized that each of the winning poker hands include constituent winning sub-hands for which the player may be compensated to increase the payoff level of winning hands. For example, a player is compensated for the values of a royal flush, a straight flush, a flush and a straight when a royal flush is obtained. The computer instructions required to play the game are stored in a read-only memory inside the machine which are executed by the microprocessor unit.

2 Claims, 3 Drawing Sheets

MULTI-PAY VIDEO POKER MACHINE

BACKGROUND AND SUMMARY OF THE INVENTION

The present invention relates generally to video games, and more particularly to video poker games. In the art of video gambling machines, video poker games generally involve the popular "Jacks or Better" poker game which is played with a standard fifty-two card deck wherein the player must obtain a hand of at least a pair of Jacks or better to win. Poker is played on a video screen. The game, including the card deck, is simulated in software which is executed by an internal microprocessor.

During game play, the player makes a wager, the deck is shuffled and cut and five cards are dealt to the player face up on the CRT. After review of the cards, the player chooses to hold from zero to five cards and discards the remainder. Additional cards are dealt to replace the cards that the player discarded. At this point, the final hand is evaluated and compared to a pay table stored in the memory associated with the microprocessor to see if the player has won or lost the wager. If the player has won, the player is paid the amount for the winning hand as listed in the pay table.

It is desirable for manufacturers of video poker games to provide a game in which certain payoff values are increased. The multi-pay poker game of the present invention is an improvement over typical video poker games because some of the payoffs made are higher when compared to typical games. Higher payoff values are achieved by compensating the player not only for the high paying hand, but also for any constituent lower paying hands which are sub-sets of the high paying hand.

For example, if a player were to have a royal flush, that player would be paid, according to the present invention, for (1) a royal flush, (2) a straight flush, (3) a straight and (4) a flush. On the other hand, if the player were playing a typical video poker game, the player would only be paid for the value of the royal flush. Accordingly, it is an object of the present invention to provide a multi-pay video poker game which provides higher payoff levels due to the inclusion of the values of the constituent sub-hands of the various winning poker hands.

DETAILED DESCRIPTION OF THE PREFERRED EMBODIMENT

Figure 1:
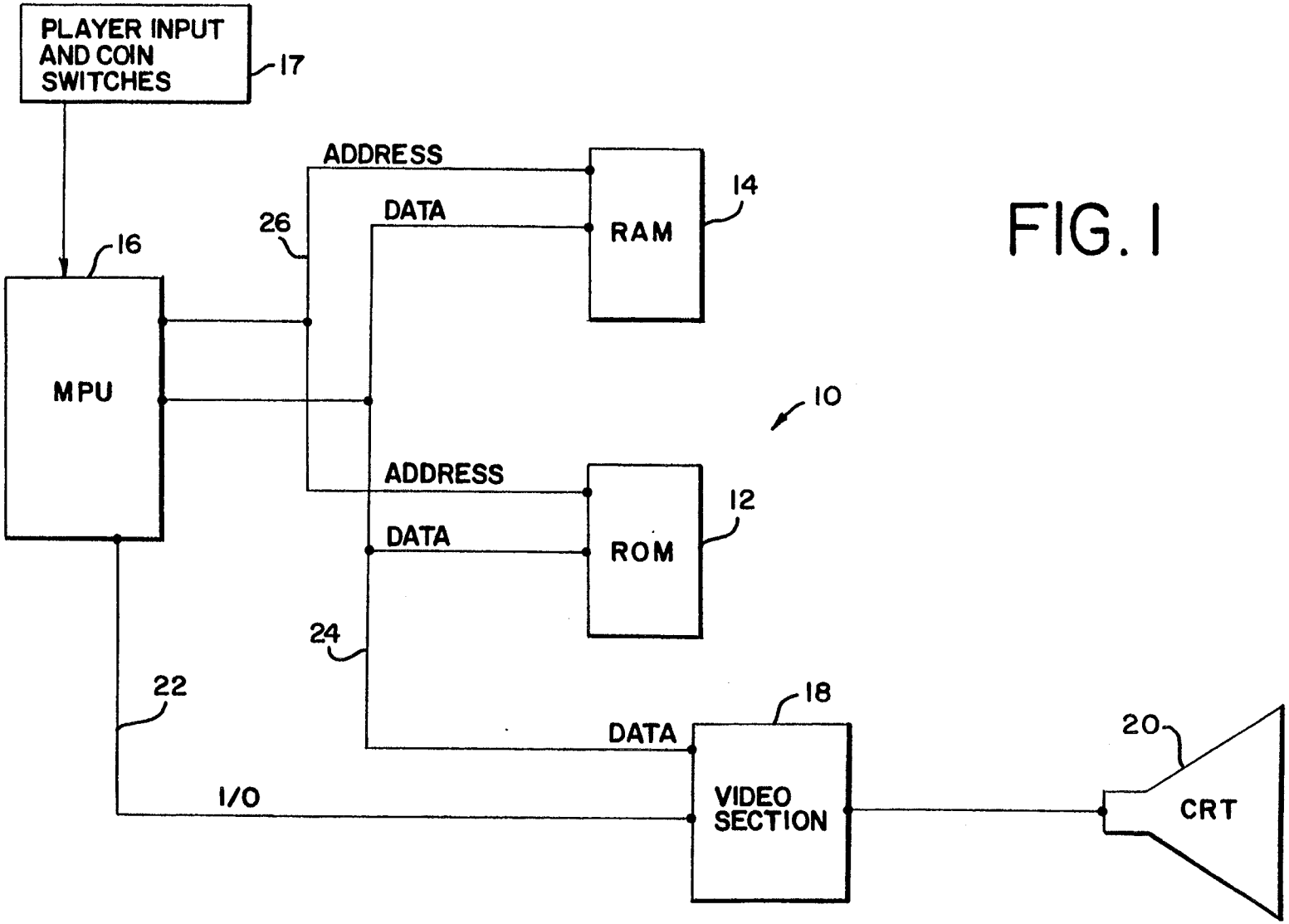
FIG. 1 is a schematic diagram of a multi-pay video poker machine suitable for practicing the present invention.

Referring to FIG. 1, the hardware 10 needed to accomplish the multi-pay video poker game of the present invention is illustrated in schematic form. Stored in read only memory 12 are all of the computer program instructions necessary to accomplish the multi-pay poker game. Random access memory 14 contains the memory used to store information associated with the actual play of the multi-pay video poker game 10 while microprocessor unit (MPU) 16 executes the instructions stored in ROM 12. Video section 18 permits the processor to display the video information relating to the game on the CRT 20.

The video section 18 is connected to the microprocessor unit 16 by input/output lines 22 which provides the pathway for the MPU 16 to respond to the input commands of the player of the game. Additionally, the video section 18 is connected with the ROM 12, the RAM 14 and the MPU 16 through the data lines 24 while the address lines 26 operatively interconnects the RAM 14, the ROM 12 and the MPU 16 such that the game can be played. The hardware of FIG. 1 is conventional. Most existing processor controlled poker machines can be programmed as described hereafter to practice the invention.

According to the present invention, the game player is compensated for the value of the highest winning hand in addition to the values of the constituent sub-hands which comprise the winning hand. Examples of a payoff scheme according to the present invention is discussed hereinafter.

TYPICAL PAYOFF TABLE FOR JACKS OR BETTER POKER

| Hand | Payoff Units |
|---|---|
| Royal Flush | 400 |
| Straight Flush | 90 |
| Four of a Kind | 22 |
| Full House | 10 |
| Flush | 8 |
| Straight | 6 |
| Three of a Kind | 3 |
| Two Pair | 1 |
| Jacks or Better | 1 |

According to the invention, if a player obtains a royal flush, then the player is compensated for the values of a royal flush, a straight flush, a flush and a straight. The sum of the values of these hands (400+90+8+6) equals 504 units. Assuming that a conventional video poker game were being played, then the payoff for obtaining a royal flush would only be 400 units. Similarly, a player would be compensated for a full house, three of a kind, two pair and, possibly, a pair of jacks or better if the final hand were a full house. It must be noted that the game steps stored in the ROM 12 can be modified to provide different payoff levels for each hand.

Figure 3:
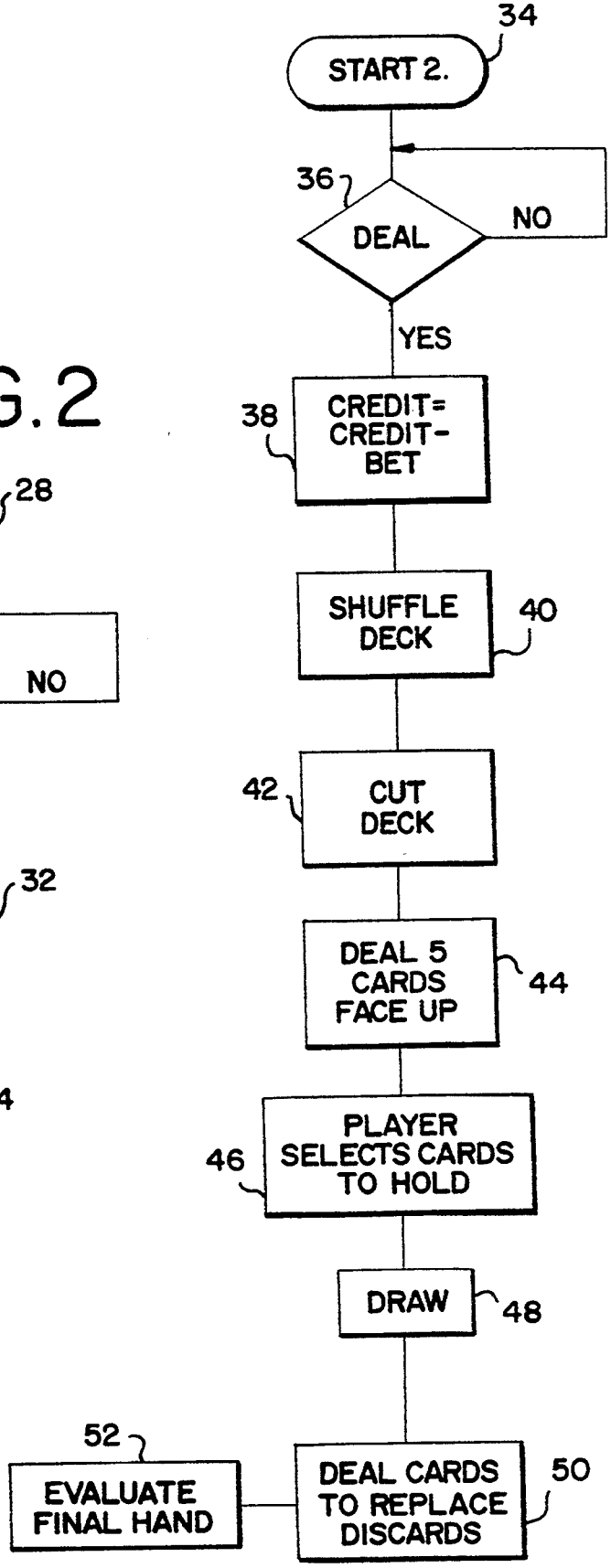
FIG. 3 is a flow diagram showing the steps associated with the play of the video poker game.
Figure 2:
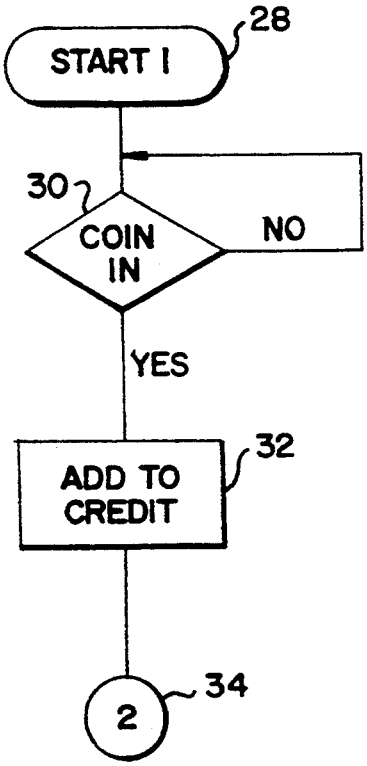
FIG. 2 is a flow diagram showing the steps associated with the player inserting coins to make a wager.
Figure 4:
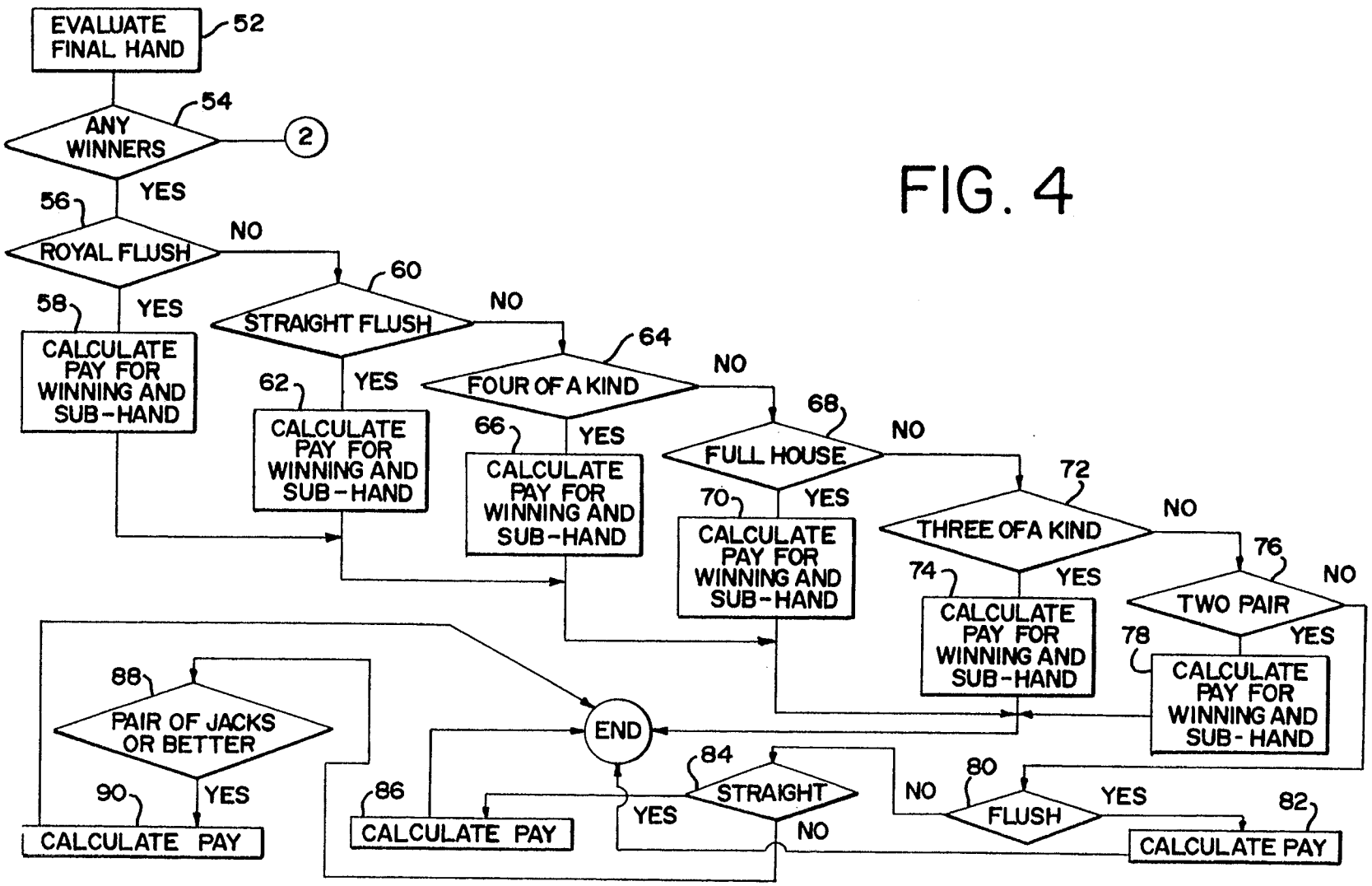
FIG. 4 is a flow diagram showing how the present invention evaluates the final hand and pays for the high hand and all of the constituent sub-hands that are associated therewith.

Referring to FIGS. 2, 3 and 4, flow diagrams are illustrated for a set of program instructions which are to be executed by the MPU 16 to accomplish multi-pay video poker as described above. It will be understood by those skilled in this art, that different hardware will use different codes. The flow diagrams however, permit the programming of the amounts in any system desired. FIG. 2 illustrates the software steps utilized at the start-up of the game. It is determined whether the game player has inserted coins at step 30. If coins were inserted, then the program adds the monetary value of the coins inserted to the players credit which is stored in RAM 14 at step 32. If the player did not insert any coins, then the machine returns to the start-up step 28. After step 32 is completed and if the credits are greater than 0, the program proceeds to game start step 34.

Referring to FIG. 3, the program steps for a typical jacks or better poker game is illustrated. Of course, it will be apparent that other variables of poker can be employed with the invention to achieve enhanced payoffs to stimulate player appeal. The player decides to place a bet during the deal step 36. After the bet is made, the program subtracts the bet from the player's credit in step 38. If the bet is larger than the remaining credits or a fixed limit, then the bet is automatically set to the value of the credit limit. Next, the program shuffles the deck 40 to randomize the card order, the "deck" is cut and five cards are dealt face up to the player in step 44.

The player then indicates which cards that are desired to be held in step 46. In step 48, the player discards the unwanted cards with the machine then dealing the replacement cards to the player in step 50. The final step listed in FIG. 3 is the evaluation step 52, wherein the program determines the amount that the player should be paid according to the player's final hand that was dealt.

FIG. 4 illustrates all of the program steps for the video poker game that are represented by step 52 of FIG. 3. The first step in the evaluation of the player's final hand is to determine whether the hand contains any winners, step 54. If there are no winners, then the program returns to the step 34. Otherwise, the program compares the player's final hand to all of the different winning hands available in the particular poker game being simulated.

In a "Jacks or Better" game, the program first checks to see if the player has obtained a royal flush, step 56. If a royal flush is present, then the player is compensated for the value of a royal flush, the value of a straight flush, the value of any flush, and the value of a straight in step 58. If a royal flush is not present, then the program proceeds to step 60 to determine whether the player's hand is a straight flush. If so, then the player is compensated for a flush, a straight and a straight flush in step 62.

If no straight flush is present, then step 64 is executed to determine whether the player's hand is a four-of-a-kind. If so, then the player is compensated for the four-of-a-kind hand, three-of-a-kind, two pair, and, possibly, a pair of jacks or better. It is then checked in step 68 to determine whether the player's hand includes a full house, in which case the player is compensated for the full house, three-of-a-kind, two pair and a pair of jacks or better if they are present, step 70. Next, it is determined in step 72 whether the hand of three-of-a-kind is present, if so, then the player is compensated for the three-of-a-kind and the presence of a pair of jacks or better in step 74.

In step 76, it is determined whether the player has two pair, for which the player is compensated for the two pair and a pair of jacks or better, if present. Finally, the player is compensated for the value of a flush, if present, in steps 80 and 82, a straight, if present, in steps 84 and 86 and one pair in steps 88 and 90, provided they are jacks or better. After the player's hand has been evaluated and the correct payoff made, the game returns to the starting position two as shown in step 34 of FIG. 3.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, wild card poker variations can be simulated by the invention as can straight poker. The principal improvement is the ability to stimulate play interest by providing higher payoffs while still maintaining the rules of poker.

What is claimed is:

1. A method of calculating the payoff to be made for the final hand in a poker game played on a video poker game machine having a microprocessor and a read-only memory (ROM) containing a game program and a pay table containing predetermined payoff values for all winning poker hands, the method comprising the steps of:

(a) determining whether the final hand is a winner;

(b) if the final hand is a winner, determining all of the winning sub-hands which are subsets of the winning final hand; and (c) calculating a payoff for both the winning final hand and the winning sub-hands by summing said predetermined payoff values for the winning final hand and said winning sub-hands.

2. A video poker game machine comprising:

(a) a microprocessor (MPU);

(b) a random access memory (RAM) and a read only memory (ROM), said ROM having a game program stored therein for controlling operation of said MPU and a pay table containing predetermined payoff values for all winning hands for the particular game to be played;

(c) means for displaying simulated poker hands including a cathode ray tube (CRT);

(d) bus means for connecting the MPU to the RAM and ROM and to said display means, (e) said microprocessor including:

(1) means for storing the current game data in said RAM, (2) means for determining whether a winning final hand has been obtained, (3) means for determining, in the event of a winning final hand, all of the constituent winning sub-hands which are subsets of the winning final hand, and (4) means for calculating an award equal to the sum of said predetermined payoff values for the winning hand and the constituent winning sub-hands; and (f) means for paying said award, whereby player interest is stimulated by permitting larger payoffs for given poker combinations.

* * * * *